United States Patent [19]

Capaccio et al.

[11] 4,415,522

[45] * Nov. 15, 1983

[54] PROCESS FOR THE CONTINUOUS PRODUCTION OF HIGH MODULUS FILAMENT OF POLYETHYLENE

[75] Inventors: Giancarlo Capaccio, Leeds; Francis S. Smith, Harrogate; Ian M. Ward, Bramhope, all of England

[73] Assignee: National Research Development Corporation, England

[ * ] Notice: The portion of the term of this patent subsequent to Mar. 3, 1998 has been disclaimed.

[21] Appl. No.: 238,852

[22] Filed: Feb. 27, 1981

Related U.S. Application Data

[63] Continuation of Ser. No. 943,855, Sep. 19, 1978, Pat. No. 4,254,072, which is a continuation of Ser. No. 860,999, Dec. 15, 1977, abandoned, which is a continuation of Ser. No. 553,656, Feb. 27, 1975, abandoned.

[30] Foreign Application Priority Data

Mar. 5, 1974 [GB] United Kingdom ..... 09795/74

[51] Int. Cl.[3] ..... D01D 5/12

[52] U.S. Cl. ..... 264/210.8; 264/237

[58] Field of Search ..... 264/210.8, 290.8, 237

[56] References Cited

U.S. PATENT DOCUMENTS

| | | | |
|---|---|---|---|
| 3,361,859 | 1/1968 | Cenzato | 264/210 F |
| 3,413,397 | 11/1968 | Bierbaum et al. | 264/210 F |
| 3,447,202 | 6/1969 | Kato | 425/72 R |
| 3,536,219 | 10/1970 | Williams | 264/210.7 |
| 3,651,196 | 3/1972 | Starkweather, Jr. | 264/178 R |
| 3,946,094 | 3/1976 | Kanetsuna et al. | 264/210 F |
| 3,962,205 | 6/1976 | Ward et al. | 264/290 R |
| 3,962,205 | 6/1976 | Ward et al. | 264/210.8 |
| 4,228,118 | 10/1980 | Wu et al. | 264/210.8 |
| 4,254,072 | 3/1981 | Capaccio et al. | 264/210.8 |
| 4,268,470 | 5/1981 | Capaccio et al. | 264/210.8 |
| 4,287,149 | 9/1981 | Capaccio et al. | 264/210.8 |

FOREIGN PATENT DOCUMENTS

| | | | |
|---|---|---|---|
| 275863 | 2/1964 | Australia | 264/176 F |
| 656080 | 1/1963 | Canada | 264/210 F |
| 667632 | 7/1963 | Canada | 264/210 F |
| 792165 | 8/1968 | Canada . | |
| 2410747 | 9/1974 | Fed. Rep. of Germany . | |
| 2247322 | 4/1975 | Fed. Rep. of Germany . | |
| 2509557 | 9/1975 | Fed. Rep. of Germany . | |
| 2430772 | 12/1975 | Fed. Rep. of Germany . | |
| 37-9765 | 7/1962 | Japan . | |
| 39-12859 | 7/1964 | Japan | 264/178 F |
| 40-1813 | 2/1965 | Japan | 264/290 |
| 69546 | 6/1974 | Luxembourg . | |
| 1469526 | 4/1977 | United Kingdom . | |
| 1480479 | 7/1977 | United Kingdom . | |
| 1498268 | 1/1978 | United Kingdom . | |
| 1506565 | 4/1978 | United Kingdom . | |

OTHER PUBLICATIONS

Clark, "Super Drawn Crystalline Polymers: A New Class of High Strength Fiber," Polymer Preprints, vol. 15, No. 1, Apr. 19, 1974, pp. 153–160.

Sheehan et al., "Production of Super-Tenacity Polypropylene Filaments," Journal of Applied Polymer Science, vol. 8, pp. 2359–2388 (1964).

Capaccio and Ward, "Properties of Ultra-High Modulus Linear Polyethylenes," Nature Physical Science, vol. 243, No. 130, p. 143 (Jun. 25, 1973).

Corneliussen et al., "The Influence of Temperature on Plastic Deformation of Polyethylene," Die Mackromolekulare Chemie, vol. 105, pp. 193–203 (1967).

Andrews et al., "The Cold-Drawing of High Density Polyethylene," Journal of Material Science, vol. 5, pp. 411–417 (1970).

Capaccio et al., "Preparation of Ultra-High Modulus Linear Polyethylenes: Effective Molecular Weight and Molecular Weight Distribution on Drawing Behavior and Mechanical Properties," Polymer, vol. 15, pp. 223–238 (Apr. 1974).

Sheehan et al., "Relationships Between Structural Parameters and Tenacity of Polypropylene Monofilaments," Textile Research Journal, Jul. 1965, pp. 626–636.

Meinel et al., "Plastic Deformation of Polyethylene. I. Change of Morphology During Drawing of Polyethylene of High Density," Journal of Polymer Science: Part A-2, vol. 8, pp. 1723–1740 (1970).

Peterlin et al., "Small-Angle X-Ray Diffraction Studies of Plastically Deformed Polyethylene. II. Influence of Draw Temperature, Draw Ratio, Annealing Temperature, and Time," Journal of Polymer Science:, Part A-2, vol. 6, pp. 1273–1282 (1968).

Barnov et al., "Super Strong Fibers of Polyethylene," Fizika Tverdogo Tela, (Lenigrad), vol. 17, No. 5, pp. 1550–1552 (1975).

Balta-Calleja et al., "Notes, The Limiting Axial Long Period of Drawn Polypropylene," Journal of Polymer Science: Part A-2, vol. 7, pp. 1275–1278 (1969).

Meinel et al., "Plastic Deformation of Polyethylene II. Change of Mechanical Properties During Drawing," Journal of Polymer Science: Part A-2, vol. 9, pp. 67–83 (1971).

*Primary Examiner*—Jay H. Woo

*Attorney, Agent, or Firm*—Finnegan, Henderson, Farabow, Garrett & Dunner

[57] ABSTRACT

A process for the production of a high modulus filament of polyethylene which comprises heating high density polyethylene to a temperature above its melting point, extruding the polymer to form a filament, subjecting the filament immediately after extrusion to a tension under such conditions that the filament is shaped without substantial orientation of its molecules, cooling the filament at a rate of cooling in excess of 15° C. per minute, and drawing the filament to a high draw ratio.

2 Claims, No Drawings

PROCESS FOR THE CONTINUOUS PRODUCTION OF HIGH MODULUS FILAMENT OF POLYETHYLENE

This is a continuation of application Ser. No. 943,855 filed Sept. 19, 1978, now U.S. Pat. No. 4,254,072, which is a continuation of Ser. No. 860,999 filed Dec. 15, 1977, now abandoned, which is a continuation of Ser. No. 553,656, filed Feb. 27, 1975, now abandoned.

This invention relates to certain new polymer materials and to processes for making such materials.

A continuing demand for filaments and fibres having a high modulus has resulted in the commercial production of carbon fibres having a modulus of $4.2\times10^{11}$ N/m$^2$, but such fibres are expensive, because of their complex method of manufacture, by comparison with filaments and fibres spun from high molecular weight organic polymers such as polyethylene, polypropylene, polyamides, and polyesters. U.K. Patent Application Nos. 10746/73 and 46141/73 describe shaped articles, and particularly filaments, films, and fibres, of high density polyethylene, having a Young's modulus (dead load creep) of at least $3\times10^{10}$ N/m$^2$, and in certain cases greater than $5\times10^{10}$ N/m$^2$, values far higher than those of presently commercially available high density polyethylene articles. These high values approach the estimated theoretical value for crystalline high density polyethylene of $24\times10^{10}$ N/m$^2$. According to U.K. Patent Application No. 10746/73 shaped articles of high density polyethylene having such high values for the modulus can be obtained from polymers having a weight average molecular weight ($\overline{M}w$) of less than 200,000 a number average molecular weight ($\overline{M}n$) of less than 20,000 and a ratio of $\overline{M}w/_{Mn}$ of less than 8 where $\overline{M}n$ is greater than $10^4$, and of less than 20 where Mn is less than $10^4$. The shaped articles are obtained by cooling the polymer from a temperature at or close to its melting point at a rate of 1° to 15° C. per minute followed by drawing the cooled polymer.

It has now been found possible to produce shaped articles having a high modulus from high density polyethylene by a process in which the polymer is cooled at a rate far in excess of 15° C. per minute followed by drawing under controlled conditions.

The present invention provides a process for the production of a high modulus filament of polyethylene which comprises heating high density polyethylene to a temperature above its melting point, extruding the polymer to form a filament, subjecting the filament immediately after extrusion to a tension under such conditions that the polymer is shaped without substantial orientation of its molecules, cooling the filament at a rate of cooling in excess of 15° C. per minute and drawing the filament to a high draw ratio.

In this specification high density polyethylene means a substantially linear homopolymer of ethylene or a copolymer of ethylene containing at least 95% by weight of ethylene having a density of from 0.85 to 1.0 gms/cm$^3$ as measured by the method of British Standard Specification No. 2782 (1970) method 509B on a sample prepared according to British Standard Pat. No. 3412 (1966) Appendix A and annealed according to British Standard Pat. No. 3412 (1966) Appendix B (1), such as for example that produced by polymerising ethylene in the presence of a transition metal catalyst. Preferred polymers have a weight average molecular weight of not more than 200,000.

The polymer is heated to a temperature above its melting point, preferably in the range of 150° to 320° C., most preferably from 190° to 300° C., for example 230° to 280° C., and may be extruded at that temperature by any suitable means through a die or spinneret. Immediately after extrusion it is subjected to a tension under such conditions that the polymer is shaped by being drawn whilst hot without substantial orientation of its molecules, that is to say, the polymer retains a low degree of birefringence. Preferably the polymer has a birefringence of not more than $3\times10^{-3}$.

A convenient method of shaping the polymer is to maintain it immediately after extrusion at an elevated temperature for example, by passing it through a zone of heated gaseous medium. This may be achieved during the formation of filaments by the melt spinning process, by passing the filaments on leaving the spinneret through a tube which is heated, for example, by electrical heater elements, to heat the air within the tube. The temperature of the gaseous medium adjacent to the thread line should not reach a value which will cause degradation of the polymer. This maximum value of temperature will depend upon the nature of the polyethylene, particularly whether it contains stabilisers and other such additives. On the other hand, the temperature of the gaseous medium adjacent to the filaments should be sufficiently high to maintain the filaments at a temperature whereby the applied tension to the filaments does not orientate the polymer molecules sufficiently to produce a birefringence of more than $3\times10^{-3}$. Preferably the filaments whilst passing through the zone are maintained at a temperature above their melting point. The temperature of the gaseous medium adjacent the filaments may be constant throughout the length of the zone, or may vary from one end to the other. Preferably the temperature decreases in the direction of filament travel.

Preferably the zone of heated gaseous medium is at least 1 ft in length, and the gaseous medium adjacent to the extruded filaments is heated to a temperature of at least 130° C. if the zone has a length of at least 3 ft, or to a temperature of at least (95+(105/L)°C., where L is the length of the zone in it, if the zone has a length of less than 3 ft. Such conditions ensure that the filaments remain at a temperature above their melting point during their passage through the zone.

Tension may be applied to the extruded polymer by a fowarding device such as a forwarding jet of fluid, a roll or set of rolls, or a wind-up device. The applied tension must not be excessive, and is sufficient to give filaments having a birefringence of not more than $3\times10^{-3}$.

After leaving the heated zone the polymer is cooled, for example, by natural cooling during its passage through air, or by quenching by contact with a fluid, particularly a liquid. The rate of cooling in air is far in excess of 15° C. per minute and by quenching in a liquid very high rates of cooling may be obtained. The high rate of cooling prevents excessive crystallisation of the polymer which affects the subsequent drawing of the spun filaments. Preferably the quenching restricts the degree of crystallisation in the filaments so that their density does not exceed a value of 0.96 gm per cc.

The cooled polymer is drawn either immediately, as in a spin-draw process or it may be stored in a convenient form and subsequently drawn. For example, the spun filament may be wound on a bobbin prior to drawing. In the drawing process the filament is drawn to a high draw ratio. The modulus of a filament obtained at a high draw ratio, usually greater than 10, is primarily a function of the draw ratio, the birefringence of the spun filament having very little effect. Preferably the draw ratio is at least 20. As the draw ratio is increased above 20 there is a tendency for the runnability of the drawing process to decrease, for example, the number of thread line breakages increases.

The drawing performance of the spun filaments is also controlled by the temperature of drawing. Sufficient heat should be supplied to the undrawn filaments to enable them to draw without breaking, although where the work of drawing is high, excess of heat should be removed. Conveniently drawing may take place in a heated fluid, for example a jet or bath of fluid especially a liquid, such as, for example, glycerol, particularly when a tension gradient is applied to the polymer by contacting a surface such as a snubbing pin. If a snubbing pin is used drawing may occur on and even some distance beyond the pin in which case the temperature of the polymer in the drawing zone beyond the pin should be carefully controlled to allow the drawing to take place with the dissipation of any excessive heat arising from the drawing process. To obtain the maximum draw ratio possible and the maximum modulus the temperature of the polymer immediately before and after the snubbing pin should be adequately controlled, for example by adjustment of the temperature of the fluid.

Preferably the drawing is in a liquid. The temperature of the liquid should never exceed a value of 130° C., otherwise the filaments tend to melt and are flow drawn which does not result in the filaments developing a high modulus. On the other hand, the temperature of the liquid should not fall below 90° C., otherwise the drawing process becomes unrunnable due to an excessive number of breakages in the threadline.

Spun filaments of polyethylene having a weight average molecular weight of not more than 200,000 a birefringence of not more than $3\times10^{-3}$ and a density of not more than 0.96 gms. per cc may be drawn at a temperature in the range 90° C. to 130° C. to a draw ratio in excess of 20 at draw speeds of at least 200 ft. per minute. Desirably the draw speed should not exceed Z ft. per minute, where z is given by the formula:

$$Z = 200\left[5 - 4\sqrt{\frac{(130-T)^2}{41} + \frac{(X + 5\,\Delta \times 10^3 - 20)^2}{15}}\right]$$

in which T is the temperature of the drawing fluid and is in the range

90° to 130° C.

X is the draw ratio, and is at least 20

Δ is the birefringence of the spun filament and is not more than $3\times10^{-3}$.

Preferably the high density polyethylene has a weight average molecular weight of at least 50,000, and desirably a number average molecular weight in the range 5,000 to 15,000. Even more desirably, the polymer has a ratio of weight average molecular weight $\overline{M}w$ to number average molecular weight $\overline{M}n$ such that for $\overline{M}n$ greater than $10^4$, $\overline{M}w/\overline{M}n$ is less than 8, and for $\overline{M}n$ less than $10^4$, $\overline{M}w/\overline{M}n$ is less than 20.

The invention is illustrated by the following examples:

EXAMPLES 1 TO 5, AND COMPARATIVE EXAMPLES A TO E

Polymers were spun into a single filament using a conventional spinning-machine except that an electrically heated tube having an internal diameter of 2 inches was located immediately below the spinneret. The hot filament emerging from the tube was quenched in a bath of water at 20° C. before being wound up. The spun filament is surface wound on a bobbin, and the wind up speed arranged so as to subject the filament to a tension sufficient to shape the polymer while retaining a low degree of birefringence. When a tube 3.5 ft long was used, the quench bath was positioned 16 inches below the tube, and when a tube 1.3 ft long was used, the quench was 3 inches below the tube. The polymer throughput was adjusted to give a spun yarn of 200 dtex, the spinneret hole having a diameter of 0.015 inches for all the examples, and the polymer extrusion temperature was 190° to 200° C. unless otherwise stated.

The spun filaments were drawn to the maximum draw ratio possible in a single stage over a pin of 0.5 inch diameter immersed in a bath of heated glycerol. The maximum draw ratio obtained with the draw frame was 30, and this was less than the possible maximum draw ratio for some of the filaments. Further details of the conditions of the experiments and the modulus of the drawn filaments obtained are given in Table 1 for high density polyethylene. The modulus values quoted are the ½% secant values for a 10 cm. sample extended at a rate of 1 cm. per minute at 20° C.

TABLE 1

| Example | Polymer | $\overline{M}w$ | $\overline{M}n$ | $\overline{M}w/\overline{M}n$ | Tube length (feet) | Tube temp. (°C.) | Wind-up speed (f.p.m.) | Birefringence (× $10^3$) | Draw bath temp. (°C.) | Draw speed (f.p.m.) | Max. draw ratio | Modulus (g/dtex) |
|---|---|---|---|---|---|---|---|---|---|---|---|---|
| Comparative A | High density polyethylene (Rigidex Grade 140/60) | 68,000 | 13,400 | 5.1 | 3.5 | 20 | 500 | 3.5 | 120 | 200 | 17 | 158 |
| 1 | | | | | 3.5 | 160 | 500 | <3.0 | 120 | 200 | 30[1] | 530 |
| 2 | | | | | 3.5 | 206 | 500 | 1.1 | 120 | 200 | 30[1] | 480 |
| 3 | | | | | 3.5 | 260 | 500 | <3.0 | 120 | 200 | 30[1] | 420 |
| Comparative B | | | | | 3.5 | 290 | 500 | <3.0 | 120 | 200 | 2 | — |
| 4 | | | | | 3.5 | 215 | 500 | 1.1 | 120 | 200 | 30 | 480 |
| Comparative C | | | | | 3.5 | 160 | 500 | <3.0 | 135 | 200 | 3 | — |
| Comparative D | | | | | 3.5 | 160 | 500 | <3.0 | 120 | 1000 | 3 | — |
| 5 | High density polyethylene (Rigidex | 127,000 | 6,100 | 21 | 1.3 | 324 | 84 | <3 | 120 | 200 | 25 | 280 |
| Comparative | | 4 | | | 1.3 | 20 | 84 | >3 | 120 | 200 | 15 | 180 |

TABLE 1-continued

| Example | Polymer | $\overline{M}w$ | $\overline{M}n$ | $\overline{M}w/\overline{M}n$ | Tube length (feet) | Tube temp. (°C.) | Wind-up speed (f.p.m.) | Bire-fringence ($\times 10^3$) | Draw bath temp. (°C.) | Draw speed (f.p.m.) | Max. draw ratio | Modulus (g/dtex) |
|---|---|---|---|---|---|---|---|---|---|---|---|---|
| | Grade 9) | | | | | | | | | | | |

[1]Maximum draw ratio obtainable greater than 30
[2]Polymer too degraded to draw
[3]Excessive threadline breakage during drawing
[4]Spinning temperature 200° C.

EXAMPLES 6-15 AND COMPARATIVE EXAMPLES F-J

High density polyethylene (BP Rigidex grade 140/60) was spun into a four filament yarn using a conventional spinning machine, and an electrically heated tube having an internal diameter 4 inches was located immediately below the spinneret. The hot filaments emerging from the tube were quenched in a bath of water at 20° C. before being wound up. The quench bath was positioned 6 inches below the end of the tube. The polymer throughput was adjusted to give a spun yarn of 500 decitex, the spinneret holes having a diameter of 0.009 inches for all the samples. The spun yarn was surface wound on a bobbin and the filament tension controlled by the wind up speed of the bobbin as in Examples 1 to 5.

The spun yarn was drawn in a single stage over a freely rotatable pin of 0.5 inches diameter immersed in a bath of heated glycerol. Further details of the conditions of the spinning are given in Table 2. The modulus values quoted are the 0.5% secant values for a 50 cm. sample extended at a rate of 5 cm/min. at 20° C.

Sample J was obtained by annealing the spun yarn at 120° C. before drawing.

EXAMPLE 17 AND COMPARATIVE EXAMPLE K

Yarn spun as for examples 6-15 was drawn in a steam chest 10 inches long, supplied with saturated steam at a pressure of 10 psi. The chest had narrow orifices through which the yarn entered and left the chest in order to maintain the steam pressure. No snubbing pin was used in the yarn path.

Examples 6-9 and F show the effect of draw temperature on the drawing process. As the temperature is reduced the maximum draw speed at a given draw ratio is reduced. Examples 6, 10, 11 show the effect of increasing draw ratio on maximum speed of drawing. Examples G and 7 show the combined effect of draw ratio and temperature on maximum speed.

Examples 12, 13, 14, H, I, show the effect of birefringence and shroud length and temperature on maximum draw ratio at a fixed draw speed and temperature.

Examples 15, J, show the effect of density of spun yarn.

Example 16 shows that shroud not necessary if correct birefringence and density can be achieved at spinning.

Examples 17, K, show steam drawing.

TABLE 2

| Example | Extrusion Temp. °C. | Tube Length (ft.) | Tube Temperature °C. Top | Tube Temperature °C. Bottom | Wind up Speed ft/min | Density g/cm$^3$ | Birefringence $\times 10^3$ | Drawbath Temp. °C. | Draw speed f/min | Draw Ratio | Modulus g/dtex |
|---|---|---|---|---|---|---|---|---|---|---|---|
| 6 | 260 | 3 | 240 | 180 | 500 | 0.938 | 1.1 | 125 | 1000[2] | 20 | 260 |
| 7 | | | | | | | | 115 | 550 | | |
| 8 | | | | | | | | 105 | 400 | | |
| 9 | | | | | | | | 90 | 240 | | |
| F | | | | | | | | 80 | 150 | | |
| 10 | 260 | 3 | 240 | 180 | 500 | 0.938 | 1.1 | 125 | 680[2] | 25 | 380 |
| 11 | | | | | | | | 125 | 210[2] | 30 | 470 |
| G | | | | | | | | 115 | 180[2] | 30 | 470 |
| 12 | 265 | 2 | 250 | 200 | 1000 | 0.940 | 3.0 | 125 | 200 | 20[1] | 250 |
| H | 260 | 2 | 200 | 200 | 300 | — | 3.8 | 125 | 200 | <20[1] | — |
| 13 | 265 | 2 | 300 | 250 | 500 | — | 1.8 | 125 | 200 | 28[1] | 375 |
| 14 | 280 | 1 | 300 | 300 | 700 | 0.935 | 1.5 | 125 | 200 | 20[1] | 240 |
| I | 260 | 1 | 150 | 150 | 500 | — | 2.6 | 125 | 200 | <20[1] | — |
| 15 | 290 | 3 | 300 | 300 | 700 | 0.935 | 1.2 | 125 | 200 | 28[1] | 450 |
| J | | 3 | 300 | 300 | | 0.963 | 1.2 | 125 | 200 | <20[1] | — |
| 16 | 300 | No Tube | | | 300 | 0.939 | 2.0 | 125 | 210 | 23[1] | 329 |
| 17 | 260 | 3 | 230 | 195 | 500 | — | 1.2 | Steam at | 210 | 21[1] | 260 |
| K | 260 | 3 | 230 | 195 | 500 | — | 1.2 | 115 | 270 | 16.6[1] | — |

[1]Maximum draw ratio at quoted speeds
[2]Maximum draw speed at quoted draw ratios.

EXAMPLE 16

High density polyethylene (BP Rigidex grade 140/60) was spun as for examples 6-15 except that no tube was fitted below the spinneret and the filaments passed through air at ambient temperature to a water quench bath at 20° C. positioned 2 feet below the spinneret. The yarn was then drawn as in examples 6-15.

We claim:

1. A process for the continuous production of a high modulus filament of polyethylene of $\overline{M}w$ not greater than 200,000 and $\overline{M}n$ not less than 5,000, which process comprises heating high density polyethylene to a temperature above its melting point, spinning a filament therefrom, quenching the filament at a rate of cooling in excess of 15° C. per minute and drawing the filament to a draw ratio of at least 17 to give a material having a 0.5% secant modulus greater than 158 g per dtex.

2. A process according to claim 1 wherein the spun filament has a birefringence of not more than $3.5\times10^{-3}$.

* * * * *